US006470715B1

(12) United States Patent
Toschi et al.

(10) Patent No.: US 6,470,715 B1
(45) Date of Patent: Oct. 29, 2002

(54) DYEING APPARATUS FOR CARRYING OUT LABORATORY TESTS

(75) Inventors: Fabrizio Toschi; Antonello Turle, both of Breganze (IT)

(73) Assignee: Color Service S.r.l., Dueville (IT)

( * ) Notice: Subject to any disclaimer, the term of this patent is extended or adjusted under 35 U.S.C. 154(b) by 0 days.

(21) Appl. No.: 09/537,332

(22) Filed: Mar. 29, 2000

(30) Foreign Application Priority Data

Apr. 9, 1999 (IT) ..... MI99A0720

(51) Int. Cl.[7] ..... D06B 5/16
(52) U.S. Cl. ..... 68/190; 68/207; 68/211
(58) Field of Search ..... 68/184, 185, 186, 68/187, 190, 207, 211

(56) References Cited

U.S. PATENT DOCUMENTS 178,921 A * 6/1876 Gibbs ..... 68/211 X
1,258,546 A * 3/1918 Dudley ..... 68/186
1,977,338 A * 10/1934 Hasbrouck ..... 68/211 X
2,044,458 A * 9/1936 Adams ..... 68/211

FOREIGN PATENT DOCUMENTS

DE 24 53 459 5/1976

* cited by examiner

*Primary Examiner*—Philip Coe
(74) *Attorney, Agent, or Firm*—Herbert Dubno

(57) ABSTRACT

The dyeing apparatus for carrying out laboratory tests comprises a dyeing chamber which can be sealingly coupled to at least one portion of the fabric to be dyed, means being additionally provided for displacing the dyeing liquid, adapted to carry out a sequence of alternate passages of the dyeing liquid through said fabric to be dyed.

9 Claims, 3 Drawing Sheets

DYEING APPARATUS FOR CARRYING OUT LABORATORY TESTS

FIELD OF THE INVENTION

The present invention relates to a dyeing apparatus for carrying out laboratory tests, as well as to the dyeing method used.

BACKGROUND OF THE INVENTION

As known, the purpose peculiar to laboratory dyeing tests is that of obtaining, on few grams of textile support (5/20 gr.) a dye that can be 100% industrially reproduced.

In these tests, the most difficult parameter to obtain is that of a perfect homogeneity of the dye.

The latter refers not just to an even visual appearance, but also particularly to the homogeneity in the thickness of the textile support (fabric or yarn).

Even more relevant difficulties are to be found in especially firm fabrics.

It is obvious that an even superficial appearance, which is not homogeneous in its thickness, implies a series of disadvantages causing a precarious and expensive exploitation on an industrial scale.

OBJECTS OF THE INVENTION

An object of the present invention is to eliminate the disadvantages previously reported, by providing a dyeing apparatus for carrying out laboratory tests allowing even coverage of the fabric or yarn sample so as to obtain especially homogeneous dyeing conditions, reproducible in the industrial process.

A more specific object of the invention is to provide a method which can accurately reproduce the industrial dyeing steps, by operating on a fabric or yarn that needs not be wound on a support core, and which is thus evenly covered by the dyeing bath. Another object of the present invention is to provide a dyeing apparatus which is capable of guaranteeing great reliability and safety of use.

A further object of the present invention is to provide an apparatus and a method allowing the fabric or yarn to be arranged in a plane and even form so as to be covered by the dyeing bath throughout its thickness thus affecting to the same extent both superficial and internal parts.

Still another object of the present invention is to provide a dyeing apparatus which is easily obtainable starting from elements and materials that are commonly available on the market and is, in addition, competitive from a purely economic point of view.

SUMMARY OF THE INVENTION

The aforementioned objects and others that will appear more clearly hereinafter, are achieved by a dyeing apparatus for carrying out laboratory tests, according to the invention, which comprises a dyeing chamber which can be sealingly coupled to at least one portion of the fabric to be dyed, and means for displacing the dyeing liquid carrying out a sequence of alternate passages of the dyeing liquid through the fabric to be dyed.

BRIEF DESCRIPTION OF THE DRAWING

Further features and advantages of the present invention will appear more clearly from the following detailed description of a preferred but not exclusive embodiment of a dyeing apparatus for carrying out laboratory tests, given by way of a nonlimiting example with reference to the attached drawing. In such drawing.

SPECIFIC DESCRIPTION

Figure 1:
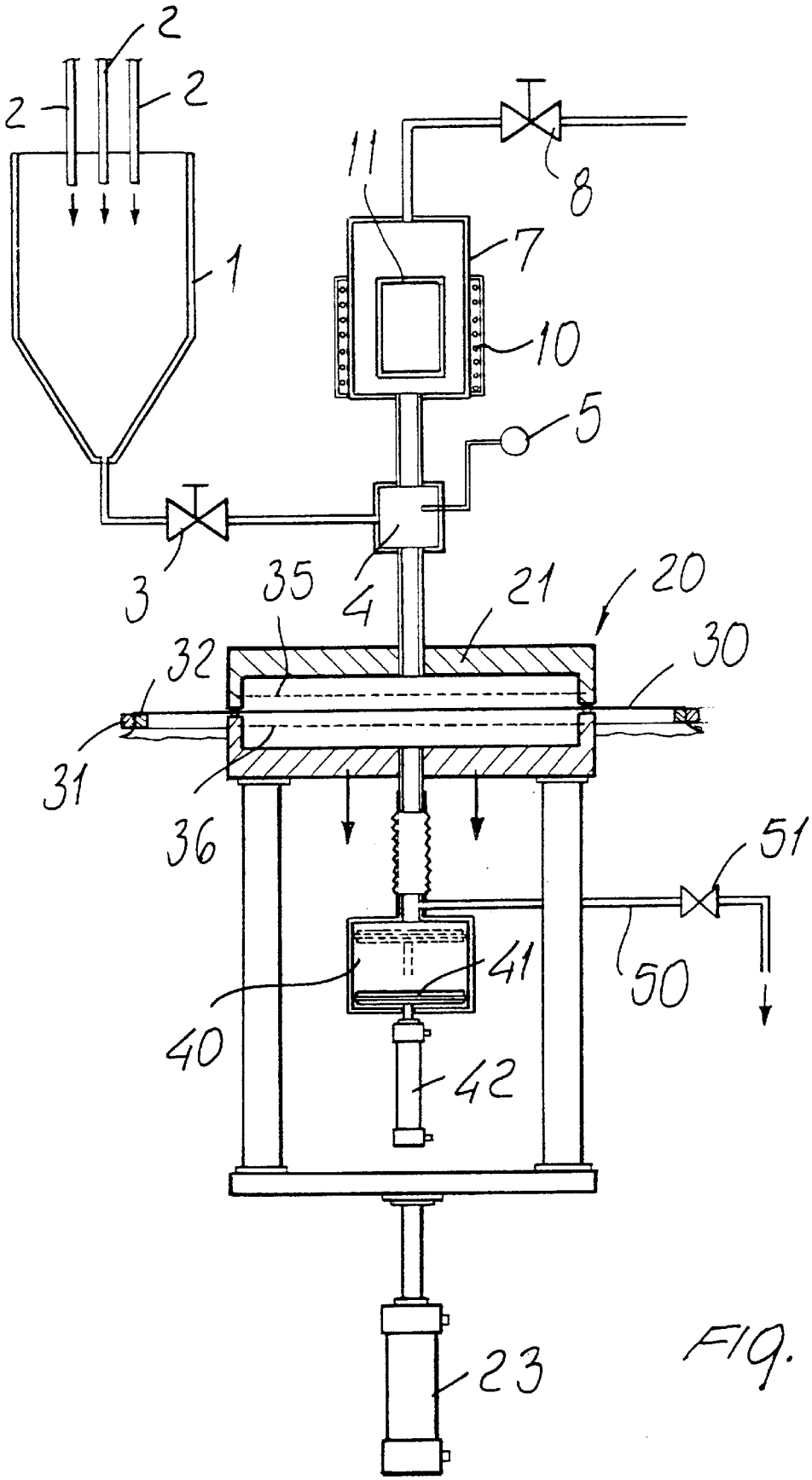
FIG. 1 schematically shows the apparatus according o the invention.
Figure 2:
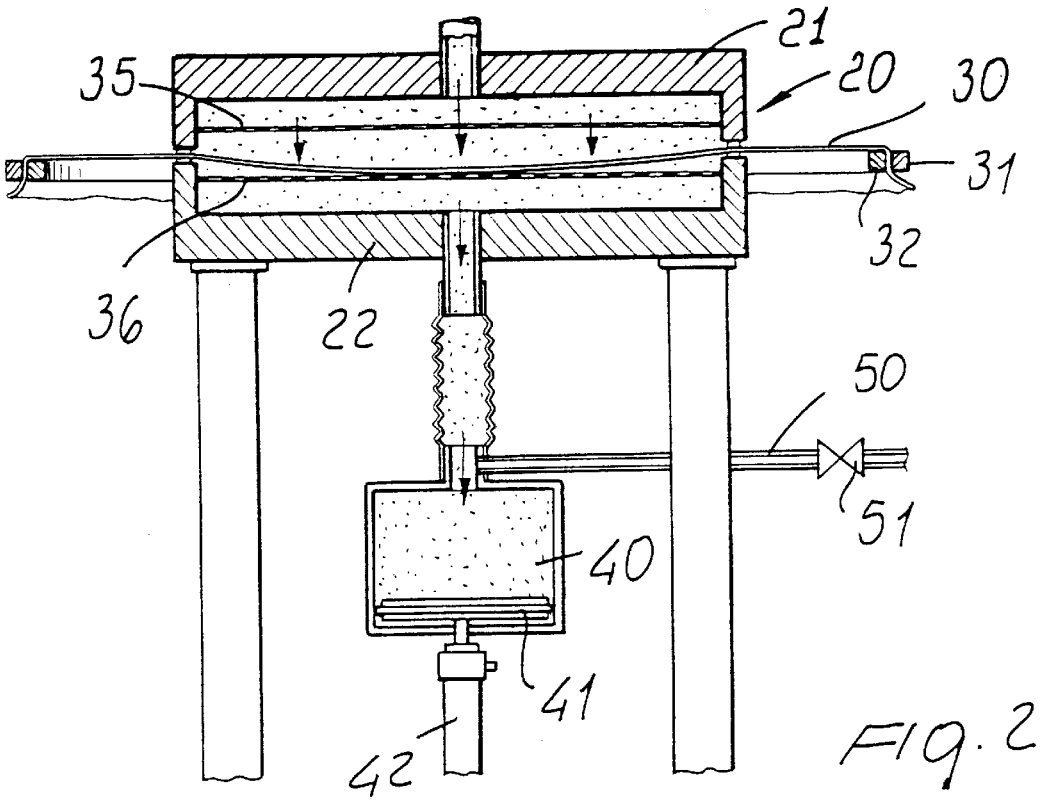
FIGS. 2 and 3 show the steps of alternate passage of the dyeing liquid through the fabric to be dyed.
Figure 3:
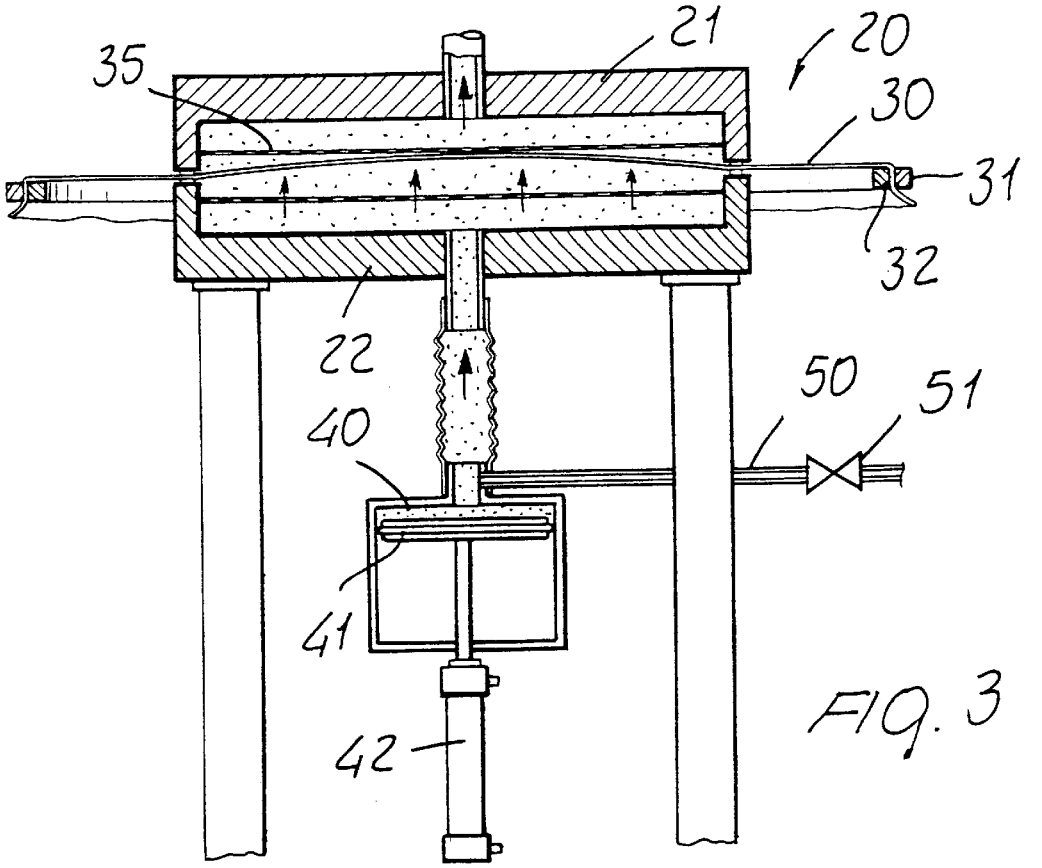

With reference to the drawing, the dyeing apparatus for carrying out laboratory tests according to the invention comprises a supply hopper 1 connected to two ducts 2 for feeding the dyeing products that will make up the dyeing bath.

The loading hopper 1 is connected, through a feed valve 3, to a distribution unit 4 wherein a thermometric robe 5 operates. The unit 4 is connected, at its upper side, to an expansion chamber 7 provided with a discharge valve 8.

A heating means for the liquid contained into the expansion chamber 7 is provided. The heater is made up of a resistor 10 wound around chamber 7.

A filling body 11 is advantageously provided inside chamber 7, featuring the function of defining a gap that increases the surface of thermal exchange with resistor 10.

The distribution unit 4 is connected, in its lower side, to a dyeing chamber, referred to as a whole with reference numeral 20, which is obtained through an upper half bearing 21 and a lower half bearing 22, which is mobile with respect to half bearing 21 for the purpose of opening and closing the chamber. The half bearing 22 is driven by a moving cylinder 23.

Half bearings 21 and 22 are arranged to sealingly couple with the fabric to be dyed, referred to with numeral 30, which is advantageously kept stretched between an outer ring 31 and an inner ring 32, which are reciprocally coupled so as to hold the fabric between them.

An upper grid 35 and a lower grid 36 are respectively provided inside half bearings 21 and 22 for limiting the fabric bulging during the manufacturing steps, as it will be better explained hereinafter; the grids are advantageously made up of perforated plates.

The lower half bearing 22 is in communication with means for displacing the liquid, or dyeing bath, which are made up of a compensation chamber 40 wherein a driving piston 41 is operating, driven by a driving cylinder 42.

A discharge duct 50 extends above the compensation chamber 40, and said duct is controlled by a discharge valve 51.

In the practical operation, the loading valve 3 is closed first, and a volume of bath at least equal to the volume of the dyeing chamber and of the compensation chamber is provided into the loading hopper 1.

At first, piston 41 is moved to the upper level after having opened the loading valve 3 and the discharge valve 8. After having filled the dyeing bath into the loading hopper 1, the discharge valve 8 is closed whereas the loading valve 3 stays open, and piston 41 is made to carry out a first suction stroke which provides to sucking a first amount of bath; then, the loading valve 3 is closed and, while keeping the discharge valve 8 open, piston 41 is made return to the upper position, so that the dyeing bath is made to move upwards to the dyeing chamber and to the expansion chamber 7.

The suction valve 8 is closed while the loading valve 3 is opened again, carrying out a further downwards movement of piston 41, which sucks a further amount of dyeing bath so as to completely fill at least the dyeing chamber and the compensation chamber.

Once this has been accomplished, the loading valve 3 is closed and a series of alternate movements of piston 41 is started so as to obtain a continuous alternate passage of the dyeing liquid through the fabric to be dyed, which is covered by the dyeing liquid on both sides and with a direction always substantially perpendicular to the lying plane.

In this way, the passage of the liquid covering the fabric is under pressure, and thus the fabric can bulge only to a limited extent since it is contained by containment grids 35 and 36.

Once the predetermined number of cycles—usually one hundred—has been carried out, the loading valve, the suction valve and the discharge valve as well are opened, so that the dyeing bath is discharged to the outside and at this point, it is possible to open the dyeing chamber and remove the fabric dyed according to methods that are totally comparable with those obtained in industrial dyeing processes, thus obtaining an especially valid sample with an even dye.

Figure 4:
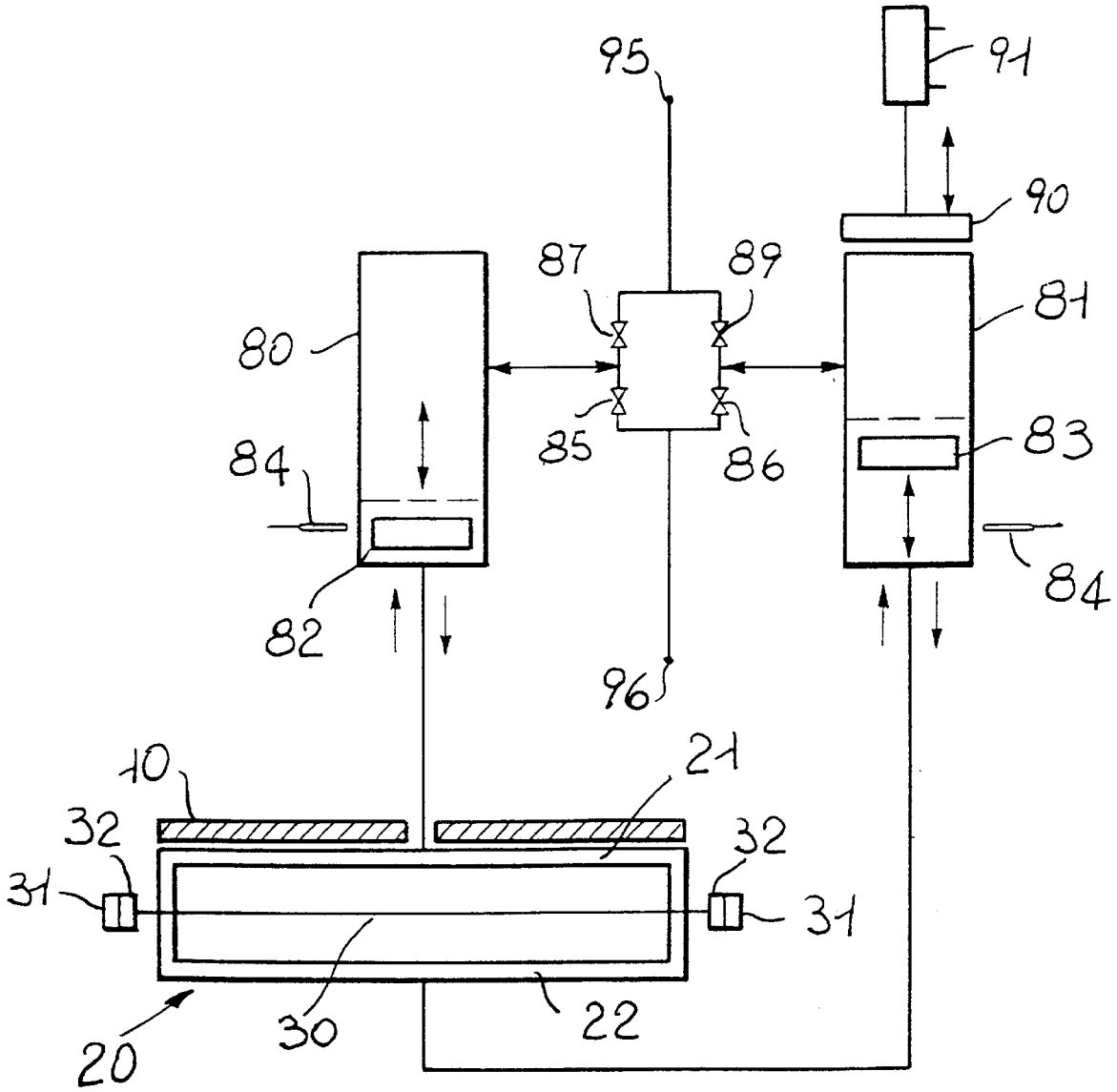
FIG. 4 schematically shows a structural variant of the displacing means according to the invention.

According to a further embodiment, the means for displacing the dyeing liquid are defined, as shown in FIG. 4, by a first and a second expansion/compression chamber 80 and 81 housing some floats 82 and 83.

The first expansion/compression chamber 80 is in communication, in its upper side, with the dyeing chamber 20, whereas the second expansion/compression chamber 81 is in communication, in its lower side, with the dyeing chamber 20. Both first and second expansion/compression chambers 80 and 81 are connected to a first source of compressed air 95 at about 1.5/3 bar, and to a second source of compressed air 96 at 1 bar through four on-off valves 85, 86, 87 and 89.

In this case, the heating resistor 10 of the dyeing bath is arranged in the upper side of the dyeing chamber 20.

Two sensors 84 for detecting the presence of floats 82 and 83 are arranged in the lower side of chambers 80 and 81.

The dyeing bath inside the dyeing chamber 20 is made move by alternatively operating with different pressures by inverting the value of pressures through the detection of floats 82 and 83.

In particular, opening the on-off valves 85 and 89 and keeping valves 86 and 87 closed, the dyeing bath moves from chamber 81 to chamber 80, since the pressure of the air introduced into chamber 81 has a greater value than that of the air introduced into chamber 80.

On the contrary, opening valves 86 and 87 and closing valves 85 and 89, being the values of pressures inverted, the dyeing bath will move from chamber 80 to chamber 81.

Through the detection of floats 82 and 83, sensors 84 make the on-off valves alternatively open and close.

A closing plug 90 is provided on the upper side of chamber 81 for closing the same, and is activated by a moving piston 91. In this way, it is possible to open or close chamber 81 to introduce the dye inside it.

Advantageously, the two chambers 80 and 81 will always be under pressure so as to prevent the dyeing bath from boiling.

The invention thus conceived can be subject to several modifications and variants, all of which falling within the scope of the invention concept.

For example, in a different embodiment the means for displacing the dyeing liquid and the expansion chamber are directly defined by the upper and lower half bearings of the dyeing chamber.

In particular, the driving piston 41 will move inside the compensation chamber 40 which will be defined by the lower half bearing itself, which will of course have larger dimensions, whereas the expansion chamber 7 will be defined by the upper half bearing itself having suitable dimensions for the purpose.

Additionally, all parts can be replaced with other technically similar elements.

In practice, the materials used as well as the relating dimensions and shapes can be of any type according to the requirements.

What is claimed is:

1. An apparatus for dyeing a fabric comprising:

a dyeing chamber sealingly engageable with a fabric to be dyed and defining a space opening onto said fabric;

a hopper containing a dyeing liquid for supplying said space;

a distribution unit communicating with said space at a lower side of said distribution unit;

a loading valve connected between said hopper and said distribution unit;

an expansion chamber connected to an upper part of said distribution unit;

a heater assigned to said distribution unit for heating dyeing liquid therein;

a thermometric probe in said distribution unit for controlling said heater; and means for displacing said dyeing liquid to draw said dyeing liquid from said expansion chamber through said fabric in one direction and displace said dyeing liquid through said fabric in an opposite direction into said expansion chamber alternately and repeatedly.

2. The apparatus as defined in claim 1, further comprising a discharge valve connected to said expansion chamber.

3. The apparatus as defined in claim 1, further comprising a filling body inside said expansion chamber and defining an interspace within said expansion chamber for increasing a contact surface exposed to said heat.

4. The apparatus as defined in claim 1 wherein said dyeing chamber is comprised of an upper half on an upper side of said fabric, a lower half on a lower side of said fabric, said halves sealingly engaging said fabric and clamping said fabric between them.

5. The apparatus as defined in claim 4, further comprising an upper grid in said upper half and a lower grid in said lower half for restricting bulging of said fabric into the respective halves during alternate displacements of the dyeing liquid through said fabric.

6. The apparatus as defined in claim 5 wherein said means for displacing said dyeing liquid includes a compensation chamber communicating with said lower half and a driving piston an cylinder arrangement for displacing liquid in said compensation chamber.

7. An apparatus for dyeing a fabric comprising:

a dyeing chamber having an upper half sealingly engageable with an upper side of a fabric to be dyed and a lower half sealingly engageable with a lower side of said fabric, said upper and lower halves defining a space opening onto said fabric;

a hopper containing a dyeing liquid for supplying said space;

a distribution unit communicating with said space at a lower side of said distribution unit;

a loading valve connected between said hopper and said distribution unit;

an expansion chamber connected to an upper part of said distribution unit; and means for displacing said dyeing liquid to draw said dyeing liquid from said expansion chamber through said fabric in one direction and displace said dyeing liquid through said fabric in an opposite direction into said expansion chamber alternately and repeatedly, said means for displacing including:

a compensation chamber communicating with said space at said lower half, and a driving piston and a driving cylinder connected to said compensation chamber for drawing said dyeing liquid into and displacing said dyeing liquid from said compensation chamber.

8. The apparatus defined in claim 7, further comprising a discharge duct connected at an upper side of said compensation chamber and controlled by a discharge valve.

9. An apparatus for dyeing a fabric comprising:

a fabric tensioner having an outer ring and an inner ring clamping said fabric between them whereby said fabric is tensioned across said inner ring;

a dyeing chamber having an upper half sealingly engageable with an upper side of said fabric within said ring and a lower half sealingly engageable with a lower side of said fabric within said ring, said upper and lower halves defining a space opening onto said fabric on opposite sides thereof;

a hopper containing a dyeing liquid for supplying said space;

a distribution unit communicating with said space at a lower side of said distribution unit;

a loading valve connected between said hopper and said distribution unit;

an expansion chamber connected to an upper part of said distribution unit; and means for displacing said dyeing liquid to draw said dyeing liquid from said expansion chamber through said fabric in one direction and displace said dyeing liquid through said fabric in an opposite direction into said expansion chamber alternately and repeatedly.

* * * * *